US010078307B2

(12) United States Patent
Mishima et al.

(10) Patent No.: US 10,078,307 B2
(45) Date of Patent: Sep. 18, 2018

(54) CROWN FOR TIMEPIECE AND TIMEPIECE

(71) Applicant: Seiko Epson Corporation, Tokyo (JP)

(72) Inventors: Yoshio Mishima, Matsumoto (JP); Atsushi Kobayashi, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/448,742

(22) Filed: Mar. 3, 2017

(65) Prior Publication Data

US 2017/0261932 A1 Sep. 14, 2017

(30) Foreign Application Priority Data

Mar. 8, 2016 (JP) ..... 2016-044285

(51) Int. Cl.
*G04B 3/04* (2006.01)
*G04B 45/00* (2006.01)

(52) U.S. Cl.
CPC ..... *G04B 3/04* (2013.01); *G04B 45/0076* (2013.01)

(58) Field of Classification Search
CPC .... G04B 45/0076; G04B 17/063; G04B 3/04; G04B 17/06; G04B 45/00
USPC ..... 368/319, 285
See application file for complete search history.

(56) References Cited

U.S. PATENT DOCUMENTS 4,473,306 A * 9/1984 Lederrey ..... G04B 47/042 368/285
7,120,093 B2 * 10/2006 Lazaretnik ..... G04B 19/025 368/80
2011/0110201 A1 * 5/2011 Boularas ..... A44C 15/0015 368/285

FOREIGN PATENT DOCUMENTS

JP 2002-062369 A 2/2002

* cited by examiner

*Primary Examiner* — Sean Kayes
(74) *Attorney, Agent, or Firm* — Harness, Dickey & Pierce, P.L.C.

(57) ABSTRACT

In a crown for a timepiece including a crown body having a recess formed therein and a decorative jewel fixed into the recess, a bonding agent is disposed between the inner side surface of the recess and the decorative jewel, and the depth dimension of the inner side surface is at least 0.5 mm.

12 Claims, 6 Drawing Sheets

CROWN FOR TIMEPIECE AND TIMEPIECE

BACKGROUND

1. Technical Field

The present invention relates to a crown for a timepiece and a timepiece.

2. Related Art

In related art, an enclosure of a wristwatch incorporates a movement that includes stepper motors and wheel trains and drives an hour hand, a minute hand, and a second hand via the stepper motors and the wheel trains. A crown is connected to the thus configured movement via a winding stem, and a transparent member (decorative jewel) for improving decorativeness is fixed to a head section of the crown (see JP-A-2002-62369, for example).

In the crown for a wristwatch described in JP-A-2002-62369 described above, a recess is formed in a head section of a crown body, a sheet on which a positioning mark is printed is disposed in the recess and fixed therein, and a UV curable bonding agent is applied onto the sheet. After the transparent member is disposed on the sheet onto which the UV curable bonding agent is applied, the resultant structure is irradiated with ultraviolet light so that the transparent member is fixed to the head section.

The crown for a wristwatch described in JP-A-2002-62369 described above is, however, problematic in that the inner side surface of the recess and the transparent member has an insufficient bonding area where they are bonded to each other via a bonding agent in some cases, and the transparent member is therefore likely to come off the recess.

SUMMARY

An advantage of some aspects of the invention is to provide a crown for a timepiece and a timepiece that allow a decorative jewel to be reliably fixed into a recess of a crown body.

A crown for a timepiece according to an aspect of the invention is a crown for a timepiece including a crown body having a recess formed therein and a decorative jewel fixed into the recess, wherein a bonding agent is disposed between an inner side surface of the recess and the decorative jewel, and a depth dimension of the inner side surface is at least 0.5 mm.

According to the aspect of the invention, the depth dimension of the inner side surface of the recess is set to be greater than or equal to 0.5 mm, a sufficient amount of ultraviolet curable bonding agent is disposed between the inner side surface and the decorative jewel. Therefore, since the inner side surface and the decorative jewel have an increased bonding area where they are bonded to each other via the bonding agent, the decorative jewel can be reliably fixed into the recess via the bonding agent. As a result, for example, the defect rate in the step of manufacturing the crown for a timepiece can be lowered. Further, even when impact acts on the decorative jewel in the recess after the manufacturing step, a situation in which the decorative jewel falls off the recess due to the impact can be avoided.

In the aspect of the invention, it is preferable that the inner side surface perpendicularly rises from a bottom surface of the recess, that the decorative jewel has a side surface parallel to the inner side surface, and that the bonding agent is disposed between the inner side surface and the side surface.

According to the aspect of the invention with this configuration, since the inner side surface of the recess perpendicularly rises from the bottom surface of the recess, and the decorative jewel has a side surface parallel to the inner side surface, the decorative jewel can be disposed in the recess with a small distance between the inner side surface and the side surface of the decorative jewel, and the bonding agent can be disposed between the inner side surface and the side surface in a roughly uniform manner. That is, the bonding force that bonds the inner side surface and the side surface to each other can be increased as compared with a case where the inner side surface and the side surface are not parallel to each other. The decorative jewel can therefore be reliably fixed to the crown body.

In the aspect of the invention, it is preferable that the side surface extends from a position on a side facing the bottom surface of the recess to a position shifted from an opening surface of the recess toward the bottom surface, that the decorative jewel has inclining surfaces that contiguously extend from an end of the side surface on a side opposite the bottom surface and incline in a direction in which the inclining surfaces separate away from the inner side surface, and the bonding agent is disposed between the inclining surfaces and the inner side surface.

In the aspect of the invention with this configuration, since the bonding agent is disposed between the inclining surfaces of the decorative jewel and the inner side surface, the decorative jewel can be fixed not only to the inner side surface of the recess but also on the side facing the opening surface. As a result, shift of the decorative jewel toward the opening surface of the recess can be reliably restricted, whereby the resistance of the crown for a timepiece against impact and other types of external force can be further increased.

In the aspect of the invention, it is preferable that the bonding agent is an ultraviolet curable bonding agent.

According to the aspect of the invention with this configuration, since the bonding agent disposed between the inner side surface of the recess and the decorative jewel is formed of an ultraviolet curable bonding agent, the bonding agent does not cure until it is irradiated with ultraviolet light. As a result, after the decorative jewel is disposed in the recess, the position of the decorative jewel can be readily adjusted.

A timepiece according to another aspect of the invention includes the crown for a timepiece described above.

According to the aspect of the invention, the same advantageous effects as those provided by the crown for a timepiece described above can be provided. Further, since the defect rate of the crown for a timepiece can be lowered, the defect rate of the timepiece including the crown for a timepiece can also be lowered.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

A first embodiment of the invention will be described below with reference to the drawings.

Figure 1:
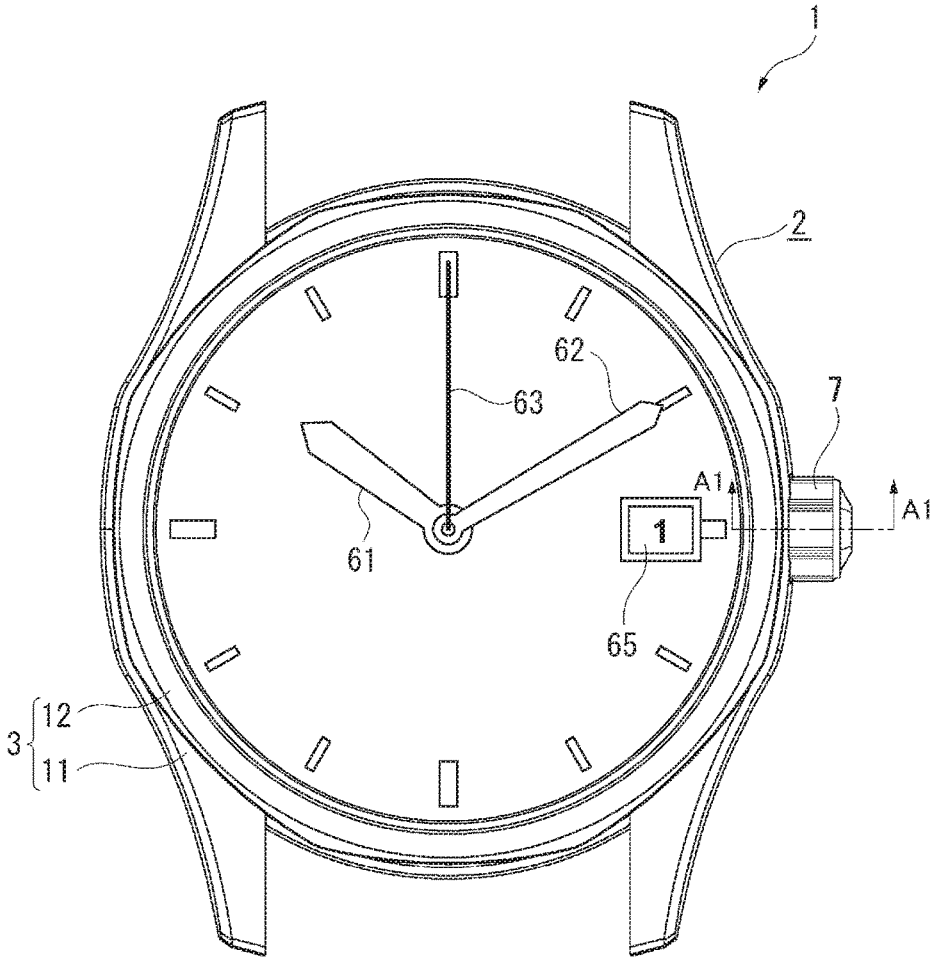
FIG. 1 is a plan view of a timepiece according to a first embodiment of the invention.
Figure 2:
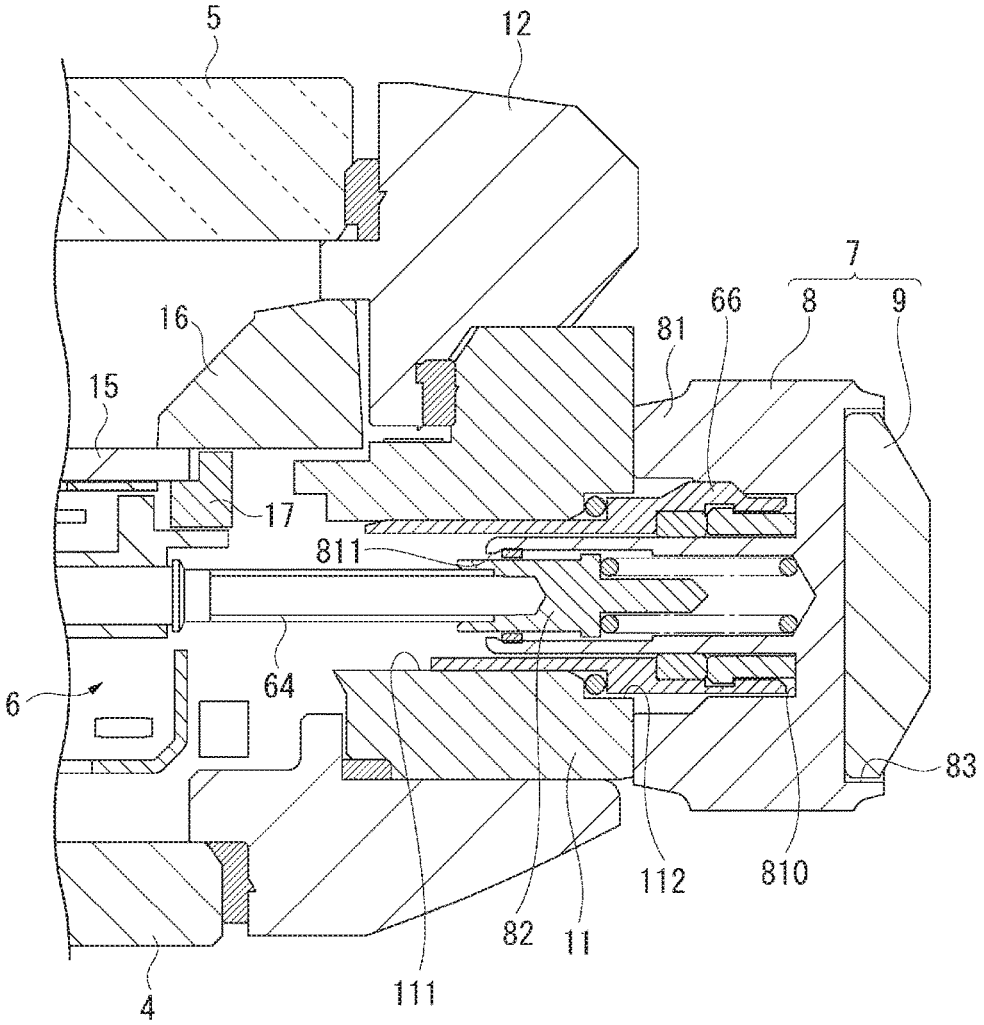
FIG. 2 is a cross-sectional view of the timepiece in the first embodiment.

FIG. 1 is a plan view of a timepiece 1 according to the present embodiment, and FIG. 2 is a cross-sectional view showing a cross section of the timepiece 1 taken long the line A1-A1 in FIG. 1.

The timepiece 1 includes an exterior case 2, which accommodates a movement, which will be described later, and other components, as shown in FIGS. 1 and 2. The exterior case 2 includes an case body 3 and a case back 4. The case body 3 includes a cylindrical barrel 11 and a bezel 12, which is provided on the front side of the barrel 11.

A through hole 111 is formed through the side surface of the barrel 11, and a crown 7 having a shaft 82, which passes through the through hole 111, is provided. The bezel 12 is formed in a ring shape. The bezel 12 and the barrel 11 are connected to each other with the aid of a fit-in structure using a protrusion and a recess formed on the opposing surfaces of the bezel 12 and barrel 11 or any other tool, such as a double-sided adhesive tape or a bonding agent. The bezel 12 may be so attached to the barrel 11 as to be rotatable relative thereto.

A cover glass plate 5, which is held by the bezel 12, is attached inside the bezel 12.

The case back 4, which has a disk-like shape and closes the rear-side opening of the case body 3, is provided on the rear side of the case body 3. The case back 4 is screwed into and hence attached to the barrel 11 of the case body 3.

Each of the barrel 11, the bezel 12, and the case back 4 is made of a metal material, such as BS (brass), SUS (stainless steel), and a titanium alloy.

Internal Structure of Timepiece

An internal structure built in the exterior case 2 of the timepiece 1 will next be described.

A movement 6, a dial 15, a dial ring 16, which is disposed along the outer circumferential edge of the dial 15, a dial receiving ring 17, and an intermediate frame (not shown) are accommodated in the exterior case 2, as shown in FIG. 2.

The movement 6 is attached to the inner circumference of the dial receiving ring described above. The dial 15 is in contact with the front surface of the dial receiving ring and attached to the timepiece-front-surface-side of the movement 6 (side facing cover glass plate 5).

Configuration of Movement

The movement 6 can be a movement having been used in a timepiece of related art. In the present embodiment, a movement including a solar panel, a secondary battery charged with electric power generated by the generator, and a stepper motor driven with the electric power supplied from the secondary battery is used.

The movement 6 may instead be a movement for a typical quartz timepiece in which the stepper motor is driven with a button-shaped primary battery or a movement including a generator that generates electric power by using a mainspring as a drive source, a secondary battery charged with electric power generated by the generator, and a stepper motor driven with the electric power supplied from the secondary battery. Still instead, the movement 6 may be a movement for a mechanical timepiece in which a wheel train is rotated with drive force produced by a mainspring and a speed adjustment mechanism adjusts the speed of the rotation.

The movement 6 in the present embodiment drives an hour hand 61, a minute hand 62, and a second hand 63 shown in FIG. 1 via stepper motors and wheel trains. The movement 6 further drives a date indicator 65 via a stepper motor and a wheel train. The layout of the indicating hands and the date indicator, the number of indicating hands and data indicators, the type of the indicating hands and the date indicator, and other factors thereof are not limited to those shown in FIG. 1.

Configuration of Crown

The crown 7 corresponds to the crown for a timepiece according to an aspect of the invention and functions as an operation section operated by a user. The crown 7 includes a crown body 8 and a decorative jewel 9, which is fixed to the crown body 8, as shown in FIG. 2. Out of the two components, the crown body 8 has a head section 81 and the shaft 82, which are made of a metal, such as brass and stainless steel.

The head section 81 has an outer end portion that protrudes from the barrel 11. The shaft 82 passes through the through hole 111 and is linked with a winding step 64, which is connected to the movement 6, in the interior of the exterior case 2.

A recess 810, which is open toward the shaft 82, is formed in the head section 81, specifically, a central portion thereof on the side facing the shaft 82. A tubular section 811 is provided in the recess 810, and the shaft 82 is fit into the tubular section 811. A recess 83, which corresponds to the recess in an aspect of the invention, is formed in the head section 81, specifically, a central portion thereof on the side opposite the shaft 82, and the decorative jewel 9 is fixed into the recess 83 via an ultraviolet curable bonding agent UV.

The configuration of the recess 83 will be described later.

The shaft 82 is disposed in a pipe 66, which is made of a metal and fixed, for example, in a brazing process, and so configured as to be slidable in the direction of the axial line of the shaft 82 via a gasket made, for example, of a synthetic resin and rotatable around the axial line.

Figure 3:
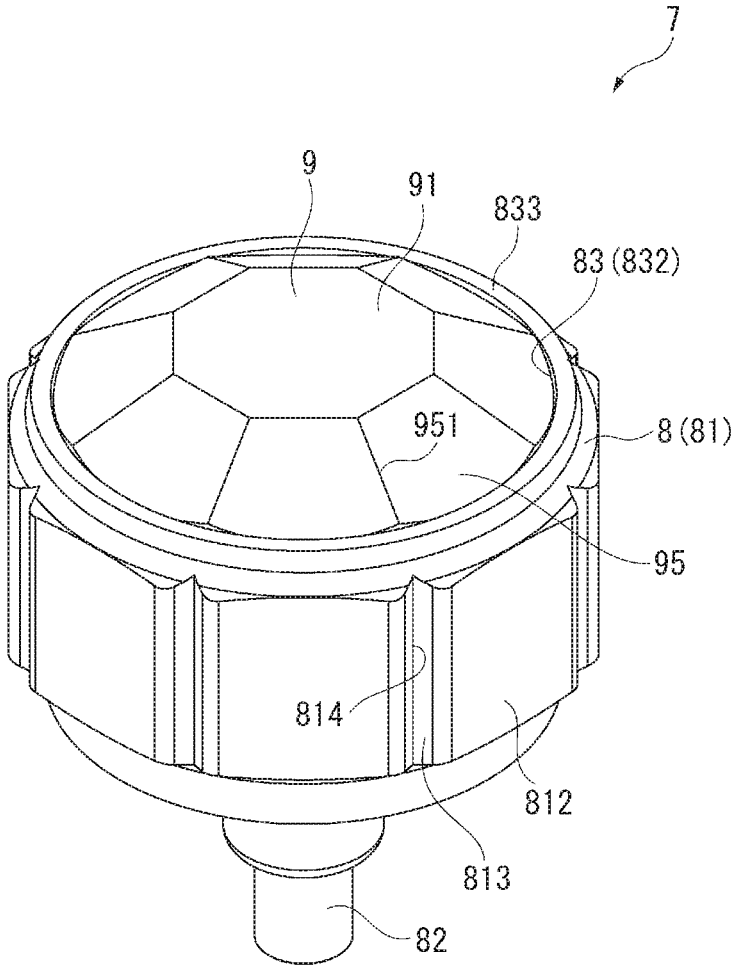
FIG. 3 is a perspective view of a crown in the first embodiment.
Figure 4:
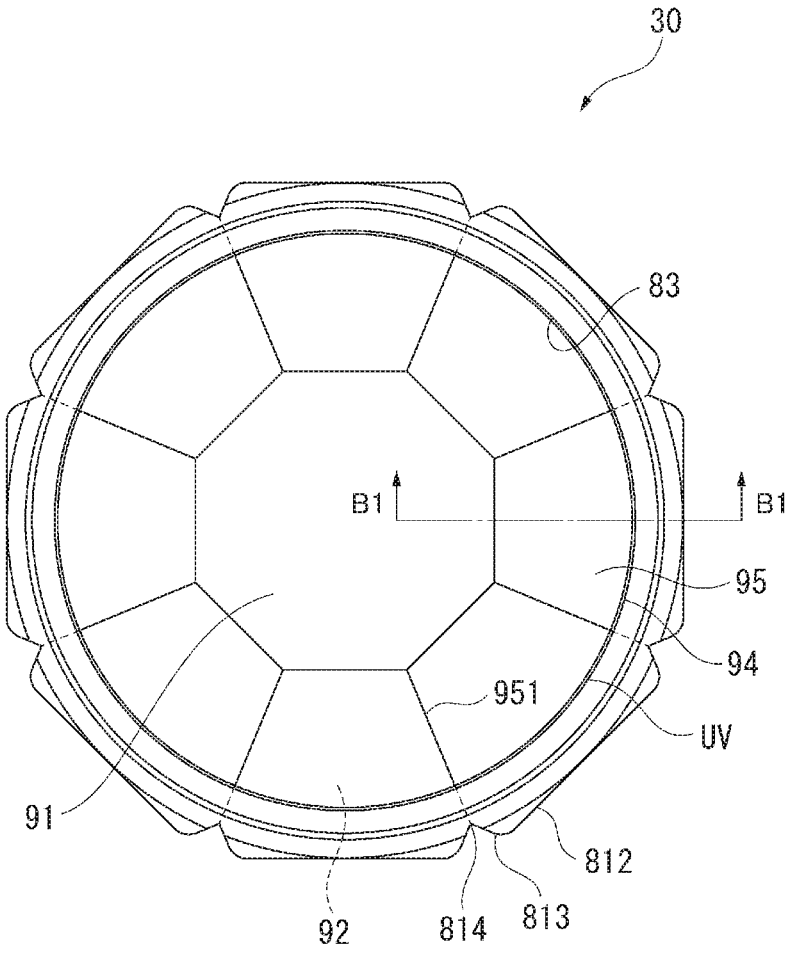
FIG. 4 is a plan view of the crown in the first embodiment.
Figure 5:
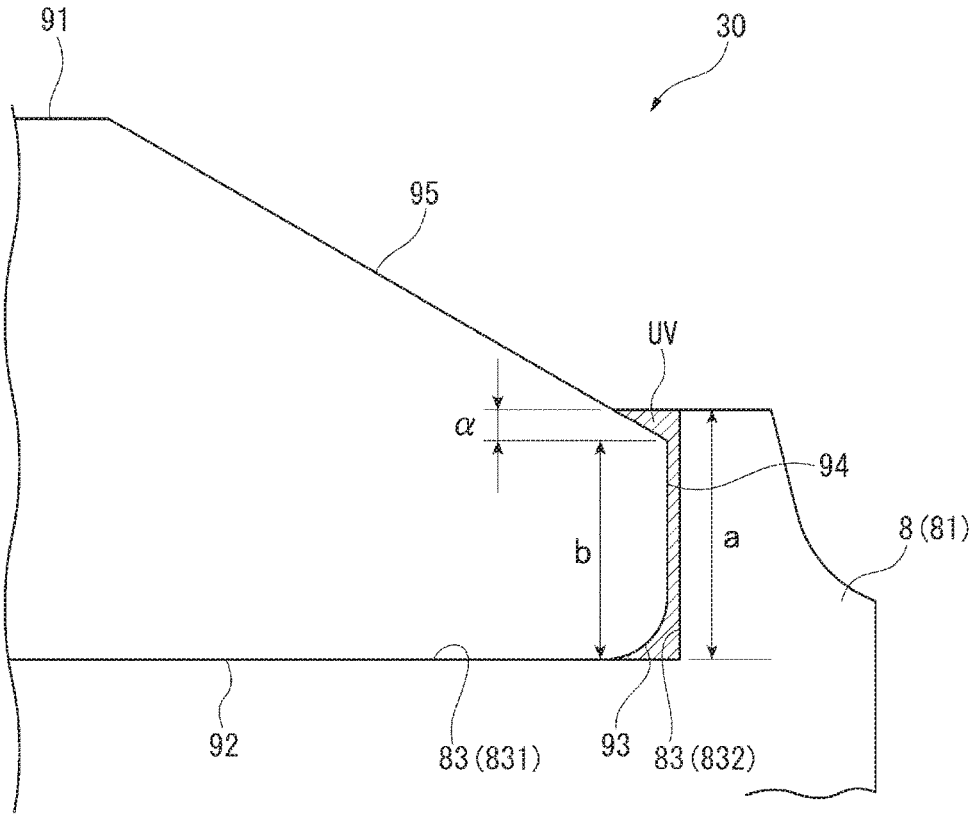
FIG. 5 is an enlarged view of the crown in the first embodiment.

FIG. 3 is a perspective view of the crown 7. FIG. 4 is a plan view of the crown 7. FIG. 5 is a cross-sectional view of the crown 7 taken along the line B1-B1 shown in FIG. 4.

Eight decorative sections 812 are formed on the outer circumferential surface of the head section 81. The decorative sections 812 are disposed on the outer circumferential surface described above at equal intervals, and a V-shaped cutout 813, which extends in the direction in which the shaft 82 extends (hereinafter referred to as first direction in some cases), is formed between adjacent ones of the decorative sections 812. That is, the cutouts 813 are disposed on the outer circumferential surface described above at equal intervals, as the decorative sections 812 described above are. Ridgelines 814 of the cutouts 813 along with ridgelines 951 of the decorative jewel 9, which will be described later, are disposed at equal intervals.

Configuration of Recess

The recess 83 is a roughly cylindrical recess into which the decorative jewel 9 is fixed, and the recess 83 is so dimensioned in the direction perpendicular to the first direction (hereinafter referred to as second direction in some cases) as to be slightly larger than the decorative jewel 9 in the second direction. The recess 83 has a bottom surface 831 and an inner side surface 832 as shown in FIGS. 3 to 5. Out of the two surfaces, the bottom surface 831, which has a roughly circular shape, is a surface with which a bottom surface 92 of the decorative jewel 9 comes into contact, and the bottom surface 831 and the bottom surface 92 are each formed of a flat surface. Therefore, when the decorative jewel 9 is disposed in the recess 83, the bottom surface 92 of the decorative jewel 9 comes into contact with the bottom surface 831 of the recess 83 with roughly no gap present between the two surfaces.

The inner side surface 832 rises perpendicularly from the bottom surface 831 of the recess 83. Specifically, the inner side surface 832 contiguously extends from the outer circumferential edge of the bottom surface 831 in the direction opposite the first direction. The inner side surface 832 has a depth dimension a set at 0.6 mm.

The ultraviolet curable bonding agent UV, which cures when irradiated with ultraviolet light, is disposed between the inner side surface 832 and the decorative jewel 9, and the decorative jewel 9 is fixed into the recess 83 when the ultraviolet curable bonding agent UV is irradiated with ultraviolet light.

When the depth dimension of the inner side surface 832 of the recess 83 is smaller than 0.5 mm, the inner side surface 832 and the decorative jewel 9 have an insufficient bonding area (contact area) where they are bonded to each other via the ultraviolet curable bonding agent UV, resulting in a high defect rate in the step of manufacturing the crown 7.

TABLE 1

| Height | Result | Number of defects/Number of parts under test | Defect rate |
|---|---|---|---|
| 0.3 | No good | 6/20 | 30% |
| 0.4 | No good | 4/20 | 20% |
| 0.5 | Good | 0/20 | 0% |
| 0.6 | Good | 0/20 | 0% |
| 0.7 | Good | 0/20 | 0% |

Specifically, it has been found that when the depth dimension of the inner side surface 832 is 0.3 mm, the number of defects is 6 versus the number of manufactured crowns 7 is 20, resulting in a defect rate of 30%, as shown in Table 1. It has also been found that when the depth dimension of the inner side surface 832 is 0.4 mm, the number of defects is 4 versus the number of manufactured crowns 7 is 20, resulting in a defect rate of 20%.

In contrast, it has been found that when the depth dimension of the inner side surface 832 is greater than or equal to 0.5 mm (when the dimension ranges from 0.5 mm to 0.7 mm), the number of defects is 0 versus the number of manufactured crowns 7 is 20, resulting in a defect rate of 0%. That is, when the depth dimension of the inner side surface 832 is set to be greater than or equal to 0.5 mm, the inner side surface 832 and the decorative jewel 9 have a sufficient bonding area where they are bonded to each other via the ultraviolet curable bonding agent UV, whereby the decorative jewel 9 is reliably fixed into the recess 83.

As described above, since the depth dimension a of the inner side surface 832 is preferably set to be greater than or equal to 0.5 mm, the depth dimension is set at 0.6 mm in the present embodiment.

Configuration of Decorative Jewel

The decorative jewel 9 is fixed into the recess 83 of the head section 81 of the crown body 8 for improvement in the aesthetic appearance of the crown 7 and hence the timepiece 1, as described above. The decorative jewel 9 is made of glass in the present embodiment.

The decorative jewel 9 has a top surface 91, the bottom surface 92, a curved surface 93, a side surface 94, and eight inclining surfaces 95, as shown in FIGS. 3 to 5.

The top surface 91 is formed in a regular octagonal shape when viewed along the direction opposite the first direction. The bottom surface 92, which faces away from the top surface 91, is formed in a roughly circular shape. The curved surface 93 is connected to the outer circumferential edge of the bottom surface 92. The curved surface 93 is curved along the direction opposite the first direction and connected to the side surface 94. The side surface 94 is a portion that perpendicularly extends from a position on the side facing the bottom surface 831 of the recess 83 to a position shifted from an opening surface 833 of the recess 83 toward the bottom surface 831. Specifically, the side surface 94 perpendicularly extends from the end of the curved surface 93 in the direction opposite the first direction. Therefore, when the decorative jewel 9 is fixed into the recess 83, the side surface 94 of the decorative jewel 9 is parallel to the inner side surface 832 of the recess 83.

The overall depth dimension b of the curved surface 93 and the side surface 94 is set to be smaller than the depth dimension a of the inner side surface 832 described above. For example, the overall depth dimension b of the curved surface 93 and the side surface 94 is set to be about 0.8 times the depth dimension a of the inner side surface 832.

The eight inclining surfaces 95 are surfaces that connect the end of the side surface 94 on the side opposite the first direction to the eight sides of the top surface 91. Each of the inclining surfaces 95 contiguously extends from the above-mentioned end of the side surface 94 and inclines in a direction in which the inclining surface 95 separates away from the inner side surface 832. In other words, each of the inclining surfaces 95 is formed in a roughly fan-like shape, inclines toward the first direction, and spreads with distance from the corresponding side of the top surface 91 toward the first direction. Adjacent inclining surfaces 95 are connected to each other with an angle formed therebetween, and the ridgeline 951 is formed between the adjacent inclining surfaces 95. That is, the decorative jewel 9 has eight ridgelines 951.

The eight ridgelines 951 along with the ridgelines 814 of the cutouts 813 are disposed at equal intervals. Therefore, for example, after the decorative jewel 9 is disposed in the recess 83 onto which the ultraviolet curable bonding agent UV is applied, the ridgelines 814 and the ridgelines 951 described above are aligned with each other, whereby the decorative jewel 9 can be readily positioned.

Configuration of Ultraviolet Curable Bonding Agent

The ultraviolet curable bonding agent UV is made of an ultraviolet curable resin, which cures when irradiated with ultraviolet light. The ultraviolet curable bonding agent UV is applied onto the bottom surface 831 of the recess 83. When the decorative jewel 9 is disposed in the recess 83 onto which the ultraviolet curable bonding agent UV is applied, the ultraviolet curable bonding agent UV applied into the recess 83 is pushed out toward the inner side surface 832 and fills the gap between the inner side surface 832 and the decorative jewel 9. In this state, the ridgelines 814 and the ridgelines 951 described above are aligned with each other, and the crown body 8 is irradiated with ultraviolet light. As a result, the ultraviolet curable bonding agent UV cures, and the decorative jewel 9 is firmly fixed into the recess 83 of the head section 81.

In the present embodiment, although not shown, the ultraviolet curable bonding agent UV is also disposed between the bottom surface 92 of the decorative jewel 9 and the bottom surface 831 of the recess 83.

The thus functioning ultraviolet curable bonding agent UV is disposed not only between the bottom surface 92 and the bottom surface 831 described above but also between the inner side surface 832 of the recess 83 and the decorative jewel 9, as shown in FIG. 5. Specifically, the ultraviolet curable bonding agent UV is disposed between the inner side surface 832 and the portion formed of the curved surface 93, the side surface 94, and part of the inclining surfaces 95 of the decorative jewel 9. In detail, since the curved surface 93 is curved along the direction opposite the first direction described above, the ultraviolet curable bonding agent UV disposed between the bottom surface 92 and the bottom surface 831 described above is pushed out, and the ultraviolet curable bonding agent UV disposed between the curved surface 93 and the inner side surface 832 is disposed along the curved surface 93.

Further, since the side surface 94 and the inner side surface 832 are parallel to each other, the ultraviolet curable bonding agent UV is uniformly disposed between the side surface 94 and the inner side surface 832. Further, since the inclining surfaces 95 extend from the end of the side surface 94 on the side opposite the first direction and inclines in a direction in which the inclining surfaces 95 separate away from the inner side surface 832, the ultraviolet curable bonding agent UV is also disposed between the inclining surfaces 95 and the inner side surface 832.

That is, the ultraviolet curable bonding agent UV overlaps with part of the inclining surfaces 95, and the thickness dimension $\alpha$ of the overlapping ultraviolet curable bonding agent UV is equal to the distance from the end of each of the inclining surfaces 95 on the first-direction side to the opening surface 833. Therefore, in the present embodiment, the depth dimension a of the inner side surface 832 is equal to the sum of the overall depth dimension b of the curved surface 93 and the side surface 94 and the thickness dimension $\alpha$ of the ultraviolet curable bonding agent UV disposed on and overlapping with the inclining surfaces 95.

As described above, in the present embodiment, the ultraviolet curable bonding agent UV is disposed between the four surfaces of the decorative jewel 9 (bottom surface 92, curved surface 93, side surface 94, and inclining surfaces 95) and the recess 83. As a result, the decorative jewel 9 is firmly fixed into the recess 83, and the decorative jewel 9 is not allowed to move in the direction opposite the first direction described above.

Advantageous Effects in First Embodiment

The timepiece 1 according to the present embodiment described above provides the following advantageous effects:

Since the depth dimension a of the inner side surface 832 of the recess 83 is set at 0.6 mm, which is greater than 0.5 mm, a sufficient amount of ultraviolet curable bonding agent UV is disposed between the inner side surface 832 and the decorative jewel 9. Therefore, since the recess 83 and the decorative jewel 9 have an increased bonding area where they are bonded to each other via the ultraviolet curable bonding agent UV, the decorative jewel 9 can be reliably fixed into the recess 83. As a result, for example, the defect rate in the step of manufacturing the crown 7 can be lowered. Further, even when impact acts on the decorative jewel 9 after the manufacturing step, a situation in which the decorative jewel 9 falls off the recess 83 due to the impact can be avoided.

Since the inner side surface 832 of the recess 83 perpendicularly rises from the bottom surface 831, and the decorative jewel 9 has the side surface 94 parallel to the inner side surface 832, the ultraviolet curable bonding agent UV can be disposed between the inner side surface 832 and the side surface 94 of the decorative jewel 9 in a roughly uniform manner. That is, the bonding force that bonds the inner side surface 832 and the side surface 94 to each other can be increased as compared with a case where the inner side surface 832 and the side surface 94 are not parallel to each other. The decorative jewel 9 can therefore be fixed to the crown body 8.

Since the ultraviolet curable bonding agent UV is disposed between the inclining surfaces 95 of the decorative jewel 9 and the inner side surface 832, the decorative jewel 9 can be fixed not only to the inner side surface 832 of the recess but also on the side facing the opening surface 833. As a result, shift of the decorative jewel 9 toward the opening surface 833 of the recess 83 can be reliably restricted, whereby the resistance of the crown 7 against impact and other types of external force can be further increased.

Since the bonding agent disposed between the inner side surface 832 of the recess 83 and the decorative jewel 9 is formed of the ultraviolet curable bonding agent UV, the ultraviolet curable bonding agent UV does not cure until it is irradiated with ultraviolet light. As a result, after the decorative jewel 9 is disposed in the recess 83, the position of the decorative jewel 9 can be readily adjusted only by aligning the ridgelines 814 and the ridgelines 951 described above to each other.

In a case where at least one of the bottom surface 831 of the recess 83 and the bottom surface 92 of the decorative jewel 9 is not a flat surface, the decorative jewel 9 cannot be stably disposed in the recess 83.

In contrast, in the present embodiment, the bottom surface 831 of the recess 83 and the bottom surface 92 of the decorative jewel 9 are each a flat surface. Therefore, when the decorative jewel 9 is disposed in the recess 83, the bottom surface 92 of the decorative jewel 9 comes into contact with the bottom surface 831 of the recess 83 with the ultraviolet curable bonding agent UV sandwiched between the two surfaces with roughly no gap therebetween. The decorative jewel 9 can therefore be stably disposed in the recess 83.

Further, in the present embodiment, since the decorative jewel 9 can be reliably fixed in the vicinity of the inner side surface 832 of the recess 83, the decorative jewel 9 may be made, for example, of a material that prevents passage of ultraviolet light. That is, since the material of a member used as the decorative jewel 9 is arbitrarily chosen, the aesthetic appearance of the crown 7 can be more likely to improved.

Second Embodiment

A timepiece 1A according to a second embodiment of the invention will next be described.

In the timepiece 1 according to the first embodiment described above, the decorative jewel 9, which is fixed into the recess 83 of the head section 81 of the crown 7, is so shaped as to have the top surface 91, the bottom surface 92, the curved surface 93, the side surface 94, and the inclining surfaces 95. In contrast, the timepiece 1A according to the present embodiment differs from the timepiece 1 described above in that a decorative jewel of the timepiece 1A has a roughly hemispherical shape different from the shape of the decorative jewel 9 described above.

In the following description, the same configurations as those in the first embodiment described above have the same reference numbers, and the description thereof will be omitted and simplified but only different points will be described in detail.

Figure 6:
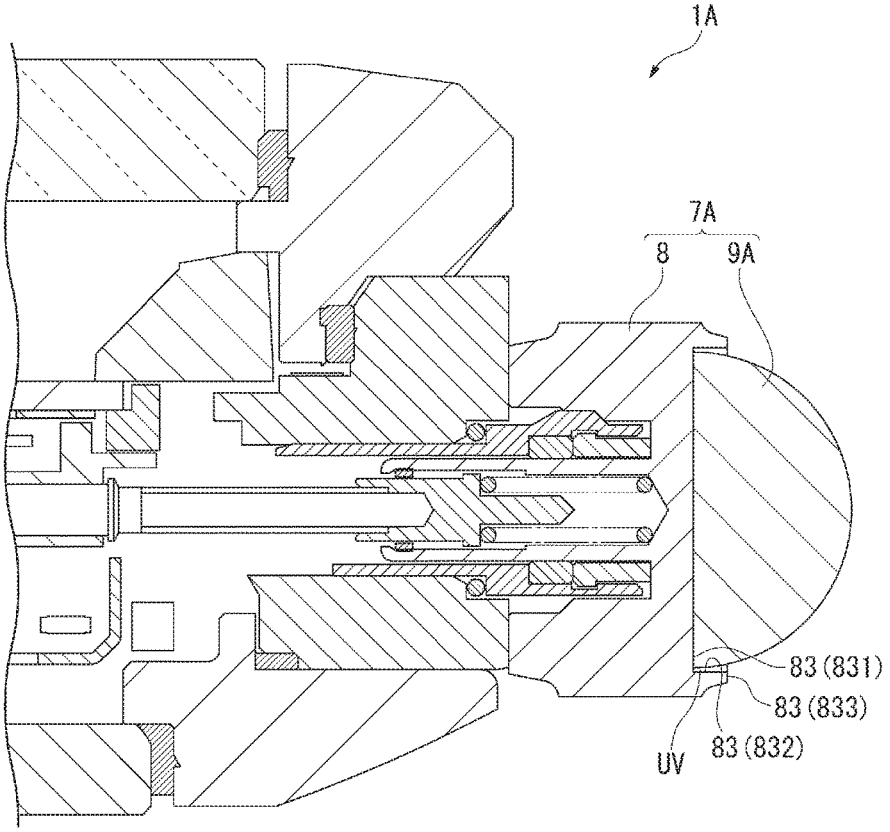
FIG. 6 is a cross-sectional view of a timepiece according to a second embodiment of the invention.

FIG. 6 is a cross-sectional view showing the timepiece 1A according to the second embodiment.

In the present embodiment, a decorative jewel 9A is fixed, in place of the decorative jewel 9, into the recess 83 of the head section 81 of the crown body 8, as shown in FIG. 6.

The decorative jewel 9A is made, for example, of a ceramic material and has a hemispherical shape. Since the decorative jewel 9A is formed in a hemispherical shape, as shown in FIG. 6, the ultraviolet curable bonding agent UV is disposed along the curved surface of the decorative jewel 9A having a hemispherical shape.

Advantageous Effects in Second Embodiment

The timepiece 1A according to the present embodiment provides the following advantageous effect as well as the same advantageous effects as those provided by the embodiment described above:

In the present embodiment, since the decorative jewel 9A is formed in a hemispherical shape, the curved surface that forms the hemispherical decorative jewel 9A and is located on the side facing the opening surface 833 can be covered with the ultraviolet curable bonding agent UV. The hemispherical decorative jewel 9A can therefore be reliably fixed.

Variations of Embodiments

The invention is not limited to the embodiments described above, and changes, improvements, and other modifications to the extent that the advantage of the invention can be achieved fall within the scope of the invention.

In each of the embodiments described above, the depth dimension a of the inner side surface 832 of the recess 83 is set at 0.6 mm, but not necessarily in the invention. For example, the depth dimension a may be 0.5 mm or 0.7 mm. That is, the depth dimension a only needs to be at least 0.5 mm.

In the first embodiment described above, the overall depth dimension b of the curved surface 93 and the side surface 94 is set to be about 0.8 times the depth dimension a of the inner side surface 832, but not necessarily in the invention. For example, the overall depth dimension b of the curved surface 93 and the side surface 94 may be about 0.5 times or 0.9 times the depth dimension a of the inner side surface 832. That is, the depth dimension b described above only needs to be smaller than the depth dimension a described above.

In each of the embodiments described above, the inner side surface 832 perpendicularly rises from the bottom surface 831 of the recess 83, but not necessarily in the invention. For example, the inner side surface 832 may not perpendicularly rise and may instead incline in a direction in which the inner side surface 832 approaches or separates away from the decorative jewel 9 or 9A.

In the first embodiment described above, the decorative jewel 9 has the side surface 94 as a rising surface that perpendicularly rises from a position on the side facing the bottom surface of the recess 83 to a position shifted from the opening surface 833 of the recess 83 toward the bottom surface 831, but not necessarily in the invention. For example, the decorative jewel 9 may instead have no rising surface, as in the second embodiment.

Further, in the first embodiment described above, the decorative jewel 9 has the inclining surfaces 95, which contiguously extend from the end of the side surface 94 as the rising surface and incline in a direction in which the inclining surfaces 95 separate away from the inner side surface 832, but not necessarily in the invention. For example, the decorative jewel 9 may have no inclining surfaces 95. That is, the decorative jewel 9 does not necessarily have the shape in the first embodiment described above and may have a triangular or quadrangular pyramidal shape or a triangular or quadrangular prism. In other words, the decorative jewel 9 may have any shape.

In the first embodiment described above, the ultraviolet curable bonding agent UV is disposed between the inclining surfaces 95 of the decorative jewel 9 and the inner side surface 832, but not necessarily in the invention. For example, no ultraviolet curable bonding agent UV may be disposed between the inclining surfaces 95 and the inner side surface 832. Even also in this case, since the ultraviolet curable bonding agent UV is disposed between the inner side surface 832 and the surface formed of the curved surface 93 and the side surface 94, roughly the same advantageous effects as those in the first embodiment described above can be provided as long as the depth dimension a described above is at least 0.5 mm. Further, in this case, since no ultraviolet curable bonding agent UV is disposed on the inclining surfaces 95, the aesthetic appearance of the decorative jewel 9 can be further improved.

In each of the embodiments described above, the bottom surface 92 of the decorative jewels 9 and 9A and the bottom surface 831 of the recess 83 are each a flat surface, but not necessarily in the invention. For example, the bottom surface of each of the decorative jewels 9 and 9A may be a protruding surface or may have a recess. In this case, the shape of the bottom surface 831 of the recess 83 only needs to be a shape according to the shape of the bottom surface 92 of the decorative jewel 9 or 9A. Even also in this case, the same advantageous effects as those in each of the embodiments can be provided.

In each of the embodiments described above, the decorative jewels 9 and 9A are made of glass and ceramic materials, respectively, but not necessarily in the invention. That is, in each of the embodiments described above, since the ultraviolet curable bonding agent UV is disposed between the inner side surface 832 of the recess 83 and the decorative jewel 9 and 9A and fixes the decorative jewel 9 and 9A to the inner side surface 832, the decorative jewel 9 and 9A may not necessarily be formed of a transparent jewel and may instead be made of an acrylic material, sapphire, ruby, Swarovski, diamond, onyx, pearl, or a plastic material.

In each of the embodiments described above, a ultraviolet curable resin (ultraviolet curable bonding agent UV) is used as the bonding agent that fixes the decorative jewels 9 and 9A into the recess 83, but not necessarily in the invention. For example, as the bonding agent described above, a silicone-based bonding agent may be used in place of the ultraviolet curable bonding agent UV. That is, any bonding agent may be used.

The entire disclosure of Japanese Patent Application No. 2016-044285, filed Mar. 8, 2016 is expressly incorporated by reference herein.

What is claimed is:

1. A crown for a timepiece comprising:

a crown body having a recess formed therein and an inner side surface in the recess;

a decorative jewel fixed into the recess, the decorative jewel having a side wall, the side wall extending perpendicular to a bottom surface of the decorative jewel, a top surface of the decorative jewel upwardly-obliquely extending from an upper end of the side wall away from the inner side surface of the crown body; and a bonding agent that is disposed between the inner side surface of the recess and the side wall of the decorative jewel, the bonding agent being disposed on part of the top surface of the decorative jewel directly adjacent to the side wall of the decorative jewel, wherein when a depth of the recess is "a" and a height of the side wall of the decorative jewel is "b," $b<a$, and the bonding agent is disposed in a cross-sectional triangle area that is formed by the inner side surface of the crown body, the part of the top surface of the decorative jewel, and a linear line extending from a top end of the inner side surface of the crown body, and the linear line is perpendicular to the inner side surface of the crown body.

2. The crown for a timepiece according to claim 1, wherein the inner side surface perpendicularly rises from a bottom of the recess, and the side wall of the decorative jewel is parallel to the inner side surface of the crown body.

3. A timepiece comprising:

the crown for a timepiece according to claim 2;

a dial; and a case body that houses the dial.

4. The crown for a timepiece according to claim 3, wherein a ratio of b/a is in a range of 0.5 to 0.9.

5. The crown for a timepiece according to claim 2, wherein a ratio of b/a is in a range of 0.5 to 0.9.

6. The crown for a timepiece according to claim 1, wherein the bonding agent is an ultraviolet curable bonding agent.

7. A timepiece comprising:

the crown for a timepiece according to claim 6;

a dial; and a case body that houses the dial.

8. The crown for a timepiece according to claim 7, wherein a ratio of b/a is in a range of 0.5 to 0.9.

9. The crown for a timepiece according to claim 6, wherein a ratio of b/a is in a range of 0.5 to 0.9.

10. A timepiece comprising:

the crown for a timepiece according to claim 1;

a dial; and a case body that houses the dial.

11. The crown for a timepiece according to claim 10, wherein a ratio of b/a is in a range of 0.5 to 0.9.

12. The crown for a timepiece according to claim 1, wherein a ratio of b/a is in a range of 0.5 to 0.9.

* * * * *